US005131480A

United States Patent [19]

Lockstedt et al.

[11] Patent Number: 5,131,480

[45] Date of Patent: Jul. 21, 1992

[54] ROTARY CONE MILLED TOOTH BIT WITH HEEL ROW CUTTER INSERTS

[75] Inventors: Alan W. Lockstedt, Tomball; Quan V. Nguyen, Houston, both of Tex.

[73] Assignee: Smith International, Inc., Houston, Tex.

[21] Appl. No.: 737,640

[22] Filed: Jul. 30, 1991

Related U.S. Application Data

[63] Continuation of Ser. No. 550,606, Jul. 10, 1990, abandoned.

[51] Int. Cl.[5] ..... E21B 10/16; E21B 10/50

[52] U.S. Cl. ..... 175/374; 175/378; 175/406; 175/429

[58] Field of Search ..... 175/406, 408, 374, 378, 175/410, 409, 411, 375; 76/108.2

[56] References Cited

U.S. PATENT DOCUMENTS

| | | | |
|---|---|---|---|
| 2,774,571 | 12/1956 | Morlan | 175/410 X |
| 3,134,447 | 5/1964 | McElya et al. | 175/332 |
| 3,137,355 | 6/1964 | Schmacher, Jr. | 175/374 |
| 3,389,761 | 6/1968 | Ott | 175/374 |
| 3,452,831 | 7/1969 | Beyer | 175/374 |
| 4,726,432 | 2/1988 | Scott et al. | 175/375 |
| 4,832,139 | 5/1989 | Minikus et al. | 175/374 |
| 4,836,307 | 6/1989 | Keshavan et al. | 175/374 |

FOREIGN PATENT DOCUMENTS

| | | | |
|---|---|---|---|
| 266990 | 12/1963 | Australia | 175/374 |
| 420747 | 8/1974 | U.S.S.R. | 175/374 |
| 473797 | 9/1975 | U.S.S.R. | 175/374 |
| 802502 | 2/1981 | U.S.S.R. | 175/378 |

OTHER PUBLICATIONS

Reed, "A Revolutionary New Bit by Reed . . . the Reed Blunt", World Oil, Mar., 1963, p. 159.

*Primary Examiner*—Hoang C. Dang
*Attorney, Agent, or Firm*—Robert G. Upton

[57] ABSTRACT

A milled tooth rotary cone rock bit, as it is operated in a borehole, subjects the heel of each cone into contact with the borehole wall when the gage row milled teeth wear. The heel row of each cone is relieved and tungsten carbide chisel inserts are equidistantly placed within the relieved heel row. The heel row inserts cooperate with the gage row milled teeth and progressively cut more of the gage of the borehole as the row of milled teeth on the gage of the cone wear. Moreover, the gage row milled teeth are partially hardfaced leaving relieved areas on the cutting side of each tooth to enhance the cutting action of the gage row of each cone.

6 Claims, 3 Drawing Sheets

ROTARY CONE MILLED TOOTH BIT WITH HEEL ROW CUTTER INSERTS

CROSS-REFERENCE TO RELATED APPLICATION

This application is a continuation application of Ser. No. 550,606 entitled, Rotary Cone Milled Tooth Bit With Heel Row Cutter Inserts filed July 10, 1990, now abandoned.

BACKGROUND OF THE INVENTION

I. Field of the Invention

This invention relates to milled teeth sealed bearing rock bits.

More particularly, this invention relates to milled teeth rotary cone rock bits, having tungsten carbide inserts dispersed in a heel row of each of the cones—the gage row milled teeth having partial hardfacing on the gage cutting side of each tooth.

II. Description of the Prior Art

Maintaining the gage diameter of an earthen borehole utilizing rotary cone rock bits is critical during operation of the rock bits in a borehole. If a rotary cone rock bit should become under gage or is worn to the point of cutting a hole diameter smaller than the original gage of the new bit, then subsequent full gage diameter rock bits will pinch and the rate of penetration will become less due to the under gage condition of the borehole.

Moreover, directional drilling has become more and more prevalent as the world oil resources become more scarce. Tapping into existing oil reserves or previously unattainable oil fields from a direction other than vertical is the most prevalent state-of-the-art method to most effectively utilize these resources. Rotary cone rock bits used in directional drilling are more subjected to bit side loads because the bit is forced to turn away from a straight or vertical penetration. Typically, a rotary cone is connected to a mud motor to drive the bit downhold. The gage rows of each of the rotary cones on the rock bit are more severely affected because of the side loads imparted to the bit during directional drilling operations.

State of the art milled teeth rotary cone rock bits utilized in drilling directional boreholes are less effective when the gage teeth wear. As the gage row teeth wear, the cutting of the gage or diameter of the borehole is compromised. In directional drilling operations, the gage row on each cone of the rotary cone rock bit must be sharp to allow the bit to change direction as it penetrates the formation. The increased area exposed by the worn gage row teeth gradually (as the bit wears) become bearing surfaces against the borehole peripheral sidewalls and it is increasingly more difficult to steer the bit in directional drilling operations.

The present invention addresses the method in which gage is cut in a borehole. Each of the milled teeth on the gage row of a milled tooth cone is partially hardfaced to extend beyond the core steel tooth on the cutting side of the tooth. The heel row adjacent to the gage row is relieved (recessed from the cone surface) and tungsten carbide or similar wear resistant inserts are equidistantly spaced in the recessed portion of the heel row. It would be obvious to space the inserts however randomly. The tungsten carbide teeth act to cut the gage of the borehole as the gage row milled teeth wear. This configuration is particularly effective in directional drilling where side loads on the drill bit particularly affect the ability to maintain gage of the borehole during directional drilling operations as heretofore described.

U.S. Pat. No. 3,134,447 teaches a tungsten carbide rotary cone rock bit having flush type tungsten carbide inserts imbedded in a heel row of each cone. The flush type inserts serve to prevent the heel portion of the bit from excessive wear, but dues not aid in cutting gage as the rock bit works in a borehole.

The present invention will tungsten carbide inserts projecting beyond the recessed heel surface of each cone aid in cutting gage as the rotary cones work in a borehole.

U.S. Pat. No. 2,774,571 illustrates a tungsten carbide rotary cone rock bit with extended tungsten carbide inserts in a gage of a rotary cone. The inserts in the gage are the primary gage cutting inserts and when they wear, the rotary cone bit will become under gage. The present invention describes milled teeth rotary cones with the gage row of milled teeth having extended hardened surfaces to cut gage with a backup series of equidistantly spaced tungsten carbide inserts that extend away from the heel row surface to further enhance or cooperate with the gage cutting milled teeth.

The prior art therefore is disadvantaged in that, when the gage cutters wear, whether the gage row is milled teeth or tungsten carbide inserts, the bit gage will go undersize leading to problems such as slow rate of penetration and for subsequent full gage rotary cone bits as heretofore described.

The present invention overcomes these disadvantages by providing enhanced gage cutting capabilities. This invention has particular application for drilling wherein the rotary cone rock bits are driven by a downhole mud motor during directional drilling operations.

SUMMARY OF THE INVENTION

It is an object of this invention to provide an improved means to cut the gage of an earthen formation borehole.

It is another object of this invention to provide a means to maintain gage of a borehole after the gage row teeth become worn by providing insert cutters in a recessed heel row formed between the gage row teeth and the journal bearing recess cavity formed in the cone.

A rotary cone milled tooth rock bit consists of a rock bit body forming a first pin end and a second cutting end. The body forms at least one leg extending toward the second cutting end. The leg forms a journal bearing adapted to rotatively receive a cutter cone.

A conically shaped milled tooth cutter cone forms a first open ended cylindrical cavity adapted to receive and rotate on the journal bearing and a second cutter end. The cone further forms one or more rows of milled teeth in a surface of the cone. A gage row of milled teeth is positioned nearest the first open end of the cone. The gage row milled teeth have hardfaced cutter surfaces formed thereon. A circumferential heel row groove is formed by the cone between the gage row milled teeth, and the cylindrical cavity. The heel row groove is recessed from the surface of the cone.

A plurality of cutter inserts are secured within the recessed heel row groove. The inserts protrude from the recessed heel row and serve to cooperate with and maintain the gage of the rock bit after the gage row milled teeth wear during operation of the bit in a borehole.

An advantage then of the present invention over the prior art is the ability to maintain gage of a borehole even though the gage row milled teeth may be worn.

Another advantage of this present invention over the prior art is the use of the dual gage cutting capability of the milled tooth bit particularly for directional drilling where the gage of the bit is constantly in contact with the formation, the bit being side loaded during operation much of the time.

The foregoing and other objects and advantages can be best understood, together with further objects and advantages, from the ensuing description taken together with the appended drawings wherein like numerals indicate like parts.

DESCRIPTION OF THE PREFERRED EMBODIMENTS AND BEST MODE FOR CARRYING OUT THE INVENTION

Figure 1:
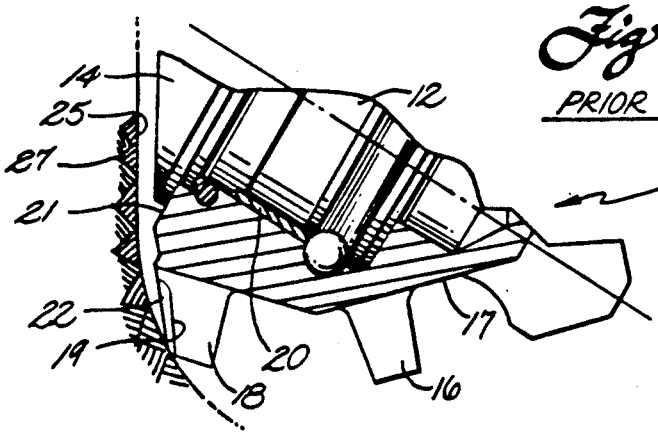
Fig. 1 PRIOR ART
FIG. 1 is a partial cross-section of a prior art cone illustrating a single gage cutting row of milled teeth.

With reference now to the prior art of FIG. 1, a state-of-the-art milled tooth cone 10 is shown assembled onto a journal bearing 12 cantilevered from the bottom of a leg 14 extending from a body of a milled tooth roller cone rock bit (not shown). A plurality of rows of milled teeth 16 project from the surface 17 of the cone 10. A gage row of milled teeth 18 are located adjacent a cylindrical bearing cavity 20 formed through the base 21 of the cone 10.

It is typical to machine a groove 19 on the cutting side of the gage row milled teeth 18. The groove or slot 19 is then filled with a hardfacing material 22 to bring each gage row tooth back out to the gage diameter of the cone 10. The hardfacing material 22 resists wear as the gage row teeth cut the gage 25 of an earthen formation 27.

As the gage row milled teeth wear, along with the hardfacing material 22, the gage 25 of the borehole will be reduced depending on the amount of wear of the gage row teeth 18. As the gage row teeth wear, the worn surface becomes more and more of a smooth bearing surface rather than a means to cut the gage, hence the gage cutting capability of the state-of-the-art milled tooth bit is compromised as heretofore stated.

Figure 2:
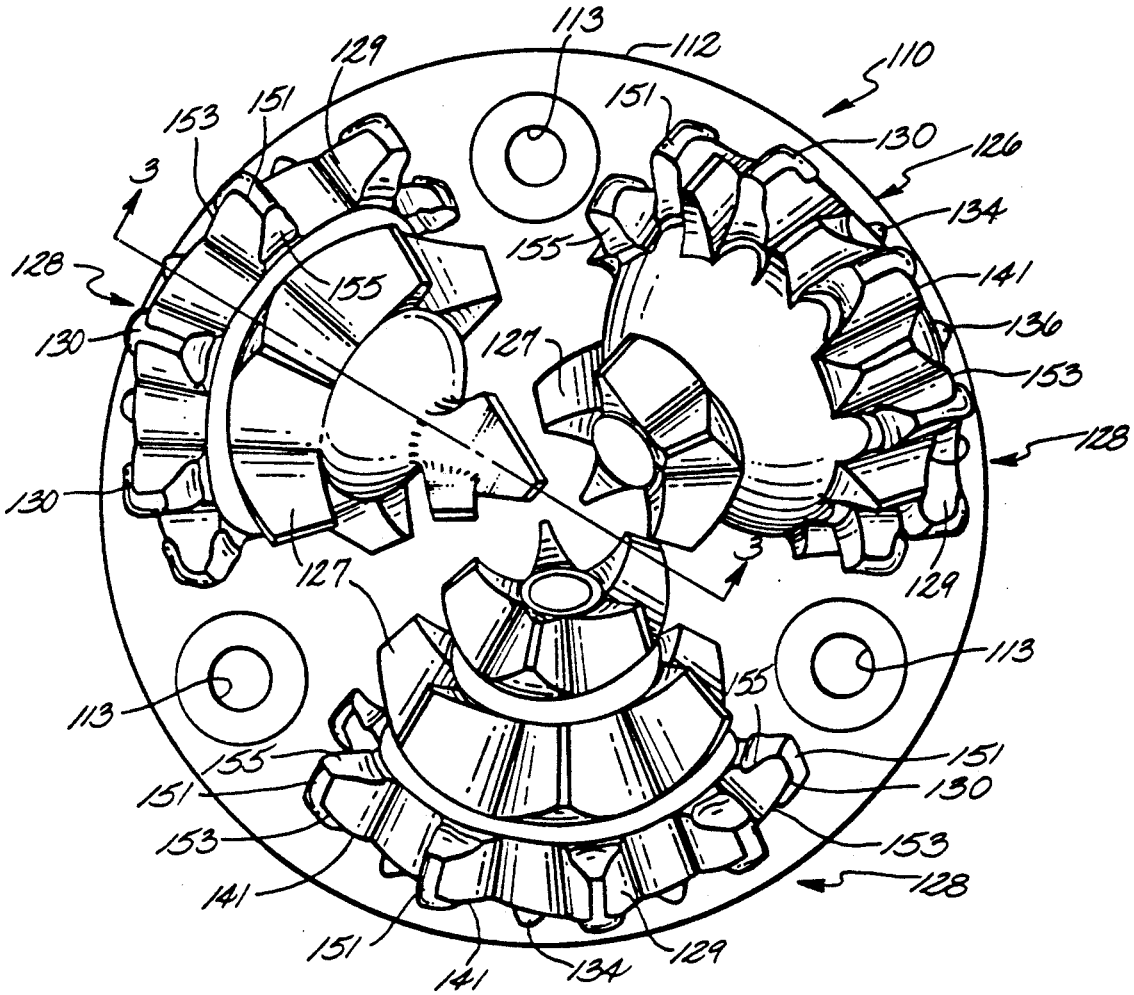
FIG. 2 is an end view of a three cone milled teeth rock bit of the present invention.
Figure 3:
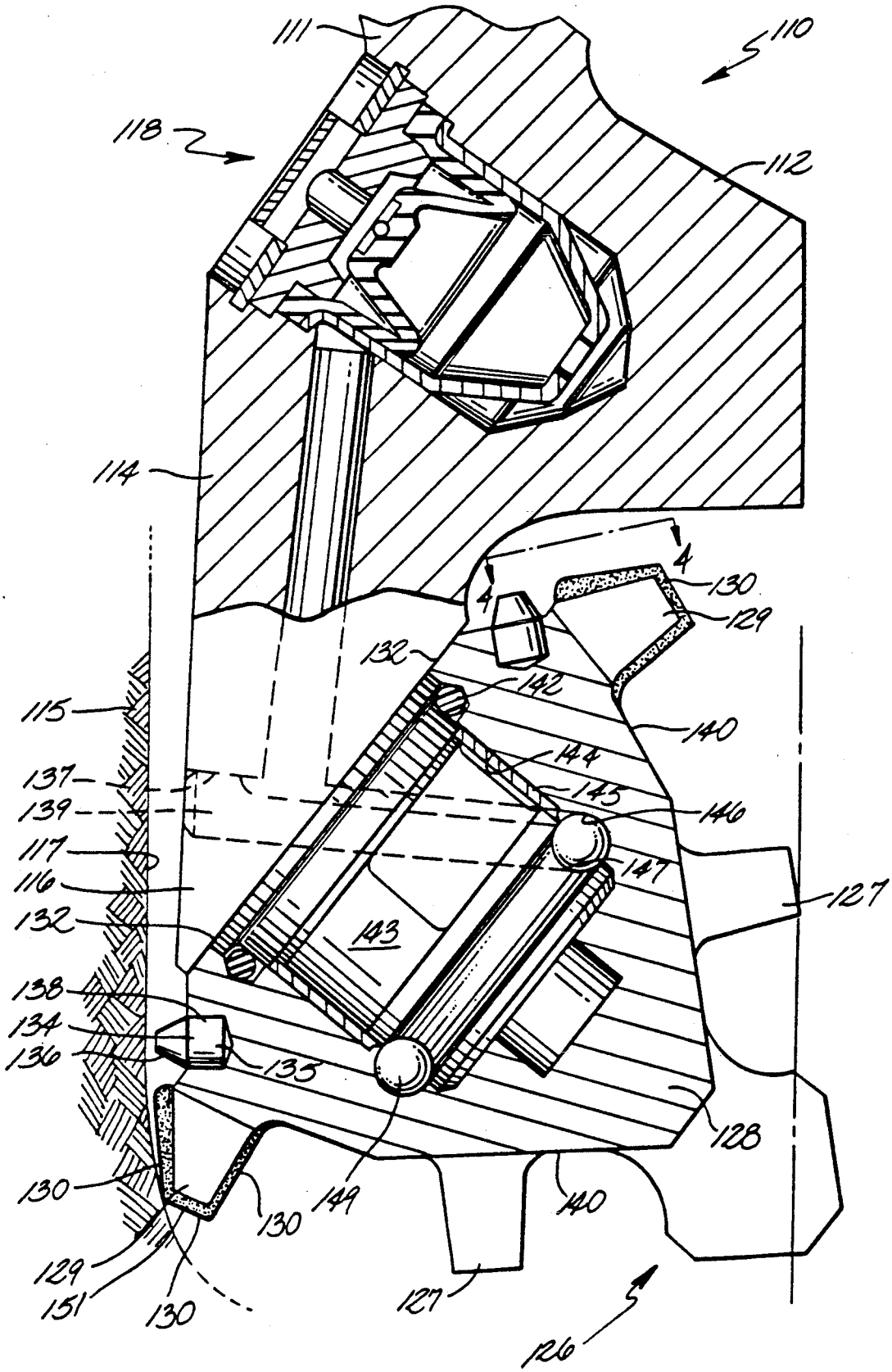
FIG. 3 is a view taken through 3—3 of FIG. 2 illustrating a partially sectioned leg and cone of a milled tooth rock bit.

With reference now to FIGS. 2 and 3, the sealed bearing milled tooth rotary cone rock bit generally designated as 110 consists of rock bit body 112, pin end 111 and cutting end generally designated as 126. Each cone 128 associated with cutting end 126 is rotatively attached to a journal bearing 143 extending from a leg 114 that terminates in a shirt tail portion 116 (FIG. 3). Each of the cones 128 has, for example a multiplicity of substantially equally spaced milled teeth 127 cut into the surface 140 of the cone 128. A lubricant reservoir, generally designated as 118, is provided in each of the legs 114 to supply lubricant to bearing surfaces formed between the rotary cones 128 bearing sleeve 145 and their respective journals 143. Three or more nozzles 113 (FIG. 2) communicate with a chamber formed inside the bit body 112 (not shown). The chamber receives drilling fluid or "mud" through a pin end 111, the fluid then is directed out through the nozzles 113 during bit operation.

A series of tungsten carbide chisel-type inserts 134 are preferred and are positioned in a recessed heel portion 133 formed in base 132 of cone 128. Each insert 134 forms a base end 135 and a chisel cutting end 136. The inserts are inserted within a circumferential recessed heel groove 133 formed between the milled teeth gage row 129 and a journal cavity 144 formed in the end 132 of cone 128. It would be obvious to use inserts other than chisel types without departing from the scope of this invention. A series of equidistantly spaced insert holes 138 are formed within groove or channel 133 in cone 128. The relieved recess channel 133 in cone 128 provides an annular space between the borehole wall 117 and the recess formed by the cone 128. The chisel end 136 of the tungsten carbide inserts 134 then protrudes from the recessed surface 133. The chisel end 136 is, of course, adjacent wall 117 of the formation 115.

The milled tooth gage teeth 129 have a partial layer of hardfacing material 130 such as tungsten carbide that provide the cutting surface adjacent the borehole wall 117 for each of the gage row milled teeth 129.

Figure 5:
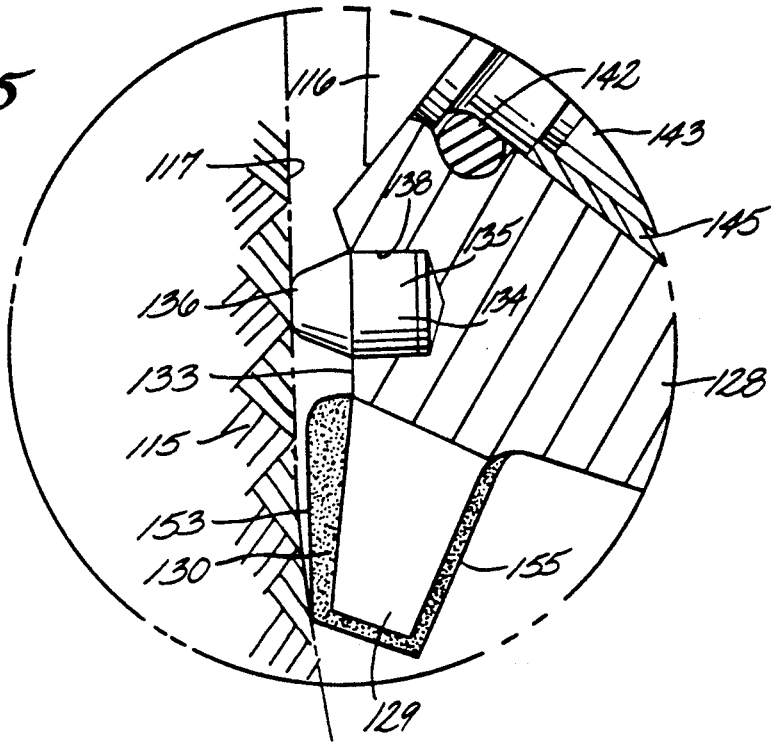
FIG. 5 is a view taken through 5—5 of FIG. 4 illustrating the relationship between the gage row milled teeth, the recessed cutter inserts and the borehole side wall.
Figure 4:
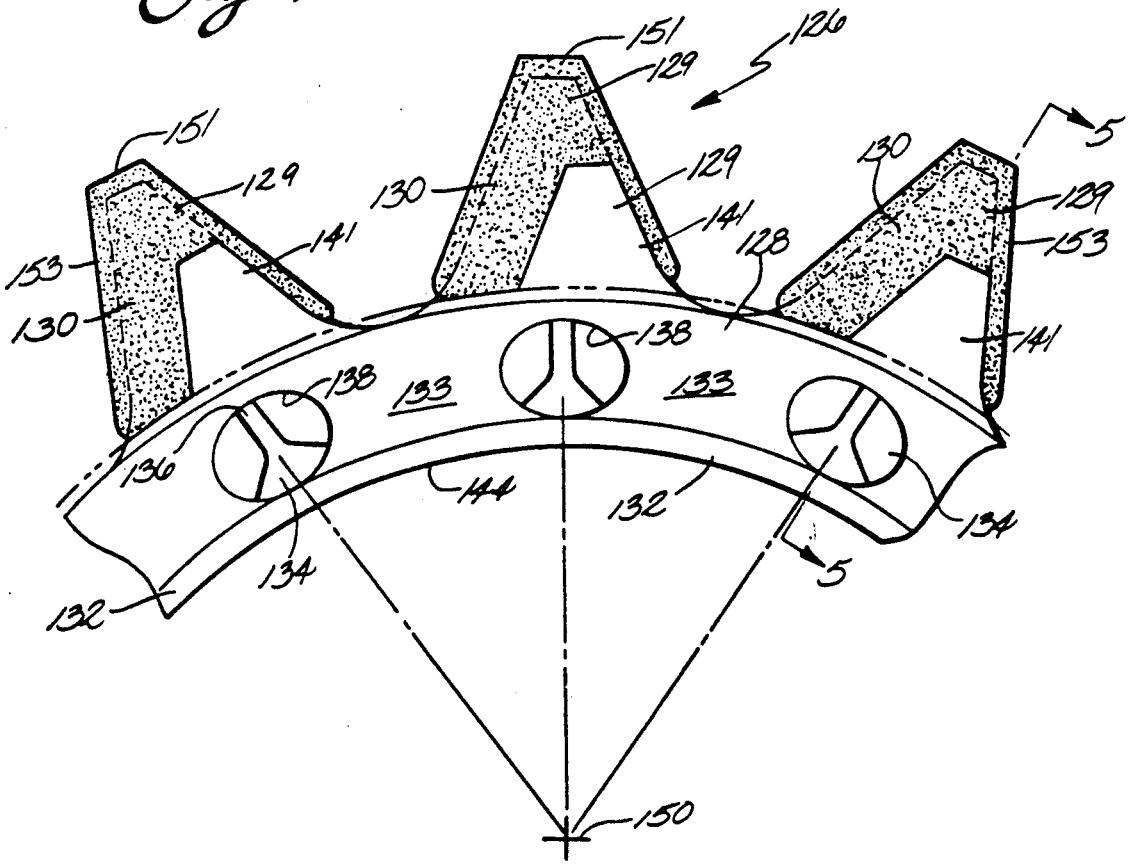
FIG. 4 is an enlarged view of the gage row milled teeth taken along 4—4 of FIG. 3 illustrating the recessed heel row with insert cutters equidistantly placed within the heel row recess.

A patented hardfacing material (U.S. Pat. No. 4,836,307) for milled teeth bits comprising a mixture of tungsten carbide particles and steel is a preferred hardfacing material for the present invention. The foregoing material is patented by the same assignee as the present invention and is incorporated herein by reference. The hardfacing material 130 partially encapsulates each of the gage row teeth. Gage row teeth 129 have hardfacing material along gage cutting surface 153 adjacent borehole wall 117, along crown 151 and along surface 155 on the inward face of each gage row tooth 129 (FIGS. 4 and 5). The unhardfaced area 141 of the tooth is now recessed to ensure that the hardfacing material 130 adjacent the borehole wall 117 stays sharp and does the cutting of the gage during operation of the milled tooth bit in the earthen formation 115. It would be obvious to encapsulate a majority of the tooth for wear resistance leaving unhardfaced surface 141.

Referring specifically to FIG. 3, the cone 128 is typically assembled over a journal bearing 143 cantilevered from the leg 114. The cylindrical journal bearing cavity 144 is bored out to accept, for example, a bearing sleeve 145 that freely rotates between a cone 128 and journal bearing 143. An O-ring 142 typically seals the area between the rotating cone and the journal to prevent lubricant from the lube reservoir 118 from escaping past the bearing surfaces formed between the cone 128, the sleeve 145 and the journal 143. Cone retention balls 149 are inserted through a ball hole 137 formed through the shirttail 116 into a ball race 146 formed in rotating cone 128 and ball race 147 in journal bearing 143. The balls 149, of course, retain the rotating milled tooth cone 128 on the journal 143. A ball hole plug 139 is inserted within the ball hole 137 after all of the ball bearings 149 are trapped within their respective rages 146 and 147. The ball plug typically is welded through the shirttail portion 116 in leg 114 after the milled tooth cone is assembled onto the journal bearing 143.

Referring now to FIG. 4, a portion of the base 132 of the cone 128 is shown to illustrate the recessed portion 133 formed in base 132 of the cone between the gage row milled teeth 129 and the journal bearing cavity 144. A series of tungsten carbide chisel inserts 134 are pressed into insert holes 138 formed in the recessed channel 133 of cone 128. The chisel crest or blade of the cutting end 136 of the tungsten carbide insert 134 is oriented within its insert cavity 138 such that the blade of the chisel crest is aligned substantially radially with respect to an axis 150 of the cone 128. Moreover, each of the inserts 134 are about equidistantly spaced one from the other within the annular recessed portion 133 of the cone 128.

Each of the gage row milled teeth 129 has hardfacing material 130 positioned on the milled teeth 129 such that the hardfacing material partially encapsulates each of the teeth 129. An exposed portion 141 along surface 153 on each of the gage row teeth 129 is then recessed such that the protruding hardfacing material 130 acts as the cutting surface of each of the gage row milled teeth 129. Hence, that portion 141 of the gage row teeth 129 not covered by the hardfacing material 130 is recessed and would not interfere or become a bearing surface as the cones 128 rotate in a borehole. The gage of a borehole and the bit rate of penetration is thus maintained during operation of the milled tooth rotary cone bit in the earthen formation 115.

During operation of the bit in a borehole, the gage row milled teeth 129 cooperate with each of the tungsten carbide chisel inserts 134 to maintain the gage of the borehole as specifically illustrated in the enlarged segment shown in FIG. 5. The tungsten carbide chisel inserts 134 and the gage row milled teeth 129 with hardfacing thereon perform as dual gage cutters and are uniquely suited to directional drilling applications where bit side loads are increased.

The enlargement of FIG. 5 distinctly illustrates the cooperation between the milled teeth gage row and the tungsten carbide chisel inserts pressed into recessed portion 133 of the cone 128. The tungsten carbide hardfacing material 130 protruding from the surface 153 of the gage row teeth 129 engage the borehole wall 117 and the cutting end 136 of the tungsten carbide inserts 134 also engage the borehole surface 117 of the earthen formation 115, thus most efficiently cutting the gage of the borehole during operation of the milled tooth bit in the borehole.

It will, of course, be realized that various modifications can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appendant claims, the invention may be practiced otherwise than as specifically illustrated and described.

What is claimed is:

1. A rotary cone milled tooth rock bit for drilling deviated holes in a directional hole drilling operation in an earthen formation comprising:

a rock bit body forming a first pin end and a second cutting end, said body having a t least one leg extending toward said second cutting end, said leg forming a shirttail portion adjacent said second cutting end, said leg forming a cylindrical journal bearing cantilevered form said shirttail portion, said bearing being adapted to rotatively receive a cutter cone;

a conically shaped milled tooth cutter cone forming a first journal bearing cavity adapted to receive said journal bearing at said second cutter end, said cone further forming one or more rows of milled teeth projected from a surface of said cone, a gage row of milled teeth being positioned nearest said first bearing cavity of said cone, each of said gage row milled teeth on the side facing the borehole wall being partially covered by hardfacing material that extends beyond the tooth, the remaining un-hardfaced portion on the side facing the borehole wall of each of the gage row milled teeth being recessed from said extended hardfacing material, said hardfacing material then becoming the cutting edge of said gage row milled tooth;

a circumferential heel groove being formed by said cone radially inwardly of said un-hardfaced portion of said gage row milled teeth and being positioned between said gage row milled teeth and said bearing journal cavity; and a plurality of substantially equidistantly spaced cutter inserts secured within said recessed circumferential heel groove, each insert having a cutting end extending radially beyond the un-hardfaced portion of the gage row milled teeth, the cutting ends of the cutter inserts and the cutting edges defined by the hardfacing material on the gage row milled teeth co-acting to cut a borehole sidewall during directional drilling operations wherein said milled tooth bit is subjected to increased side loads during the borehole redirection operation.

2. The invention as set forth in claim 1 wherein said cutter cone is formed from steel,

3. The invention as set forth in claim 2 wherein said hardfacing material is tungsten carbide.

4. The invention as set forth in claim 3 wherein said plurality of cutter inserts are tungsten carbide inserts imbedded in insert holes formed in said recessed heel groove formed in said cone.

5. The invention as set forth in claim 4 wherein said inserts are chisel type tungsten carbide inserts forming a first base end and a second cutter end.

6. The invention as set forth in claim 5 wherein said second cutter end of said chisel insert forms a blade, said blade is oriented substantially radially with respect to an axis of said cone.

* * * * *